United States Patent [19]

Wallis

[11] 4,326,402

[45] Apr. 27, 1982

[54] STOCK LIFTER FOR PROGRESSIVE DIES

[76] Inventor: Bernard J. Wallis, 25200 Trowbridge Ave., Dearborn, Mich. 48124

[21] Appl. No.: 141,686

[22] Filed: Apr. 18, 1980

[51] Int. Cl.[3] ..... B21J 13/08

[52] U.S. Cl. ..... 72/420; 72/344

[58] Field of Search ..... 72/405, 344, 351, 350, 72/427, 420, 453.01

[56] References Cited

U.S. PATENT DOCUMENTS

| | | | |
|---|---|---|---|
| 3,085,530 | 4/1963 | Williamson | 72/351 |
| 3,124,340 | 3/1964 | Williamson | 72/351 |
| 3,817,076 | 6/1974 | Wallace | 72/351 |
| 3,919,873 | 11/1975 | Biswas | 72/427 |
| 4,033,168 | 7/1977 | Fisk | 72/344 |
| 4,118,968 | 10/1978 | Ames | 72/427 |

*Primary Examiner*—Gene P. Crosby
*Attorney, Agent, or Firm*—Barnes, Kisselle, Raisch & Choate

[57] ABSTRACT

A stock lifter for progressive dies in the form of a fixedly mounted fluid cylinder designed to be charged with gas at a desired pressure. A piston within the cylinder has a piston rod projecting upwardly from within the cylinder so that its upper end is adapted to lift the stock when the downward pressure on the stock is relieved so that the piston is at all times biased upwardly. The cross sectional area of the lower side of the piston is substantially greater than the upper side of the piston and the portions of the cylinder above and below the piston are in free communication.

13 Claims, 4 Drawing Figures

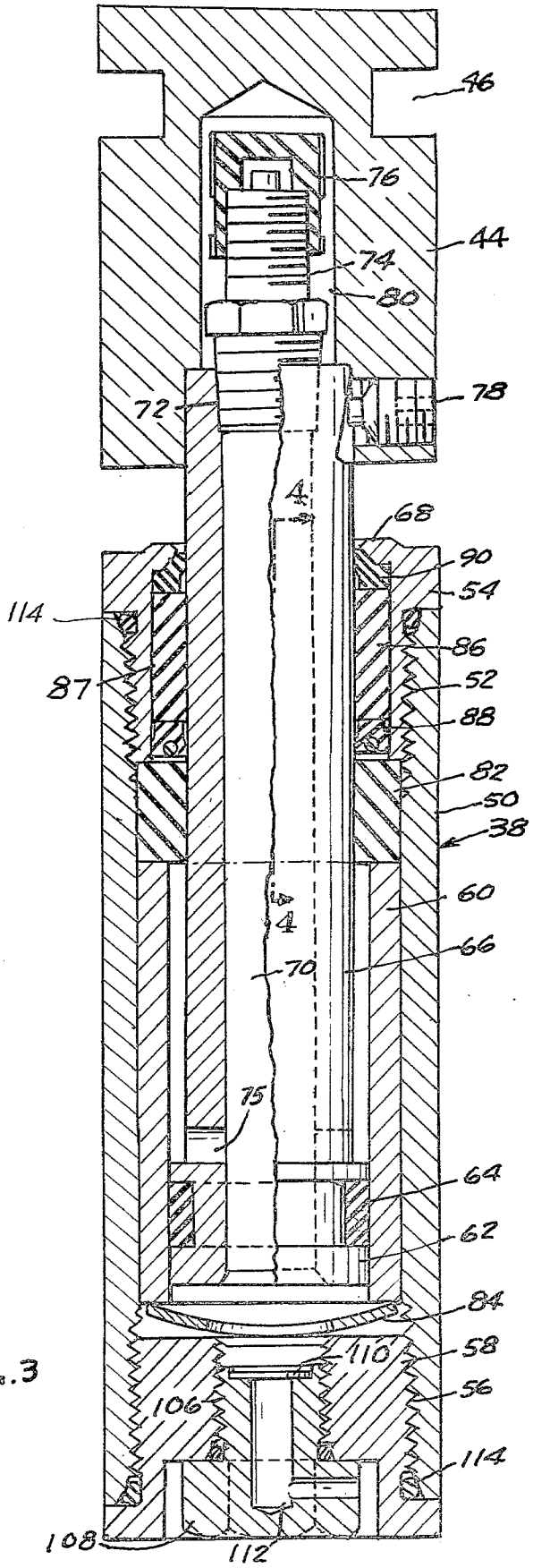
FIG. 3
FIG. 4
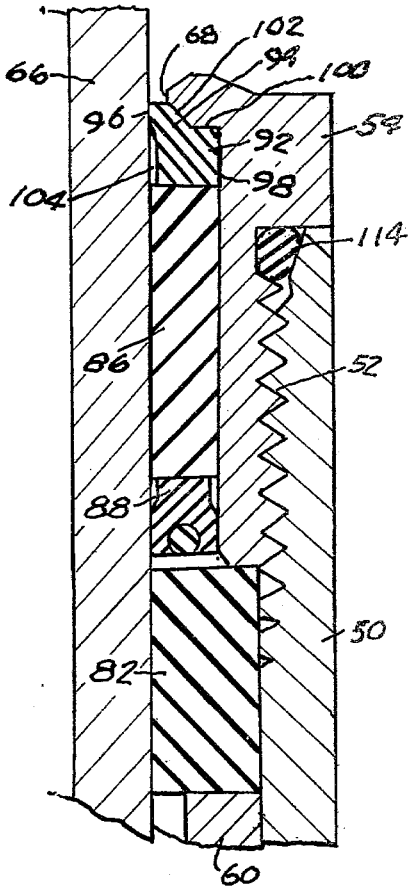
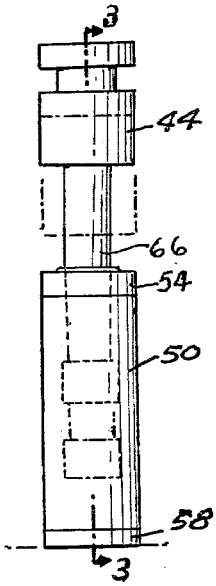
FIG. 2

STOCK LIFTER FOR PROGRESSIVE DIES

This invention relates to a stock lifter for use with progressive stamping dies, and, more particularly, to a lifter of this type that is gas pressure operated.

When workpieces are formed between progressive stamping dies it is usually necessary to employ a device for lifting the stock between the successive strokes of the press so that it can be advanced to the next successive station in the die. In the past such stock lifters have been spring operated. Spring-operated stock lifters have many objectionable features. It is sometimes difficult, because of space considerations, to obtain sufficient spring pressure to lift the stock and, as a result, the stock frequently sticks in the die. Likewise, it is difficult to adjust or to select springs in order to obtain sufficient, but not excessive, spring pressure on the lifter. Excessive spring pressure is a disadvantage in several respects, but primarily because it places an added load on the press since the springs have to be compressed on the stamping stroke of the press ram. Furthermore, with high speed presses springs have a tendency to fail through fatigue and require frequent replacement.

The primary object of the present invention is to eliminate the above-mentioned problems which are encountered with spring-operated stock lifters.

A more specific object of this invention is to provide a stock lifter that is operable by pressurized gas which can be readily adjusted to produce the optimum lifting force.

Another object of this invention is to provide a gas-operated stock lifter which is self-contained, occupies a minimum of space, and is inexpensive to manufacture.

Other objects, features and advantages of the present invention will become apparent from the following description and accompanying drawings, in which:

FIG. 2 is an elevational view of the stock lifter;

FIG. 3 is a sectional view taken along the line 3—3 in FIG. 2; and

FIG. 4 is a fragmentary enlarged sectional view of a portion of the structure shown in FIG. 3.

Figure 1:
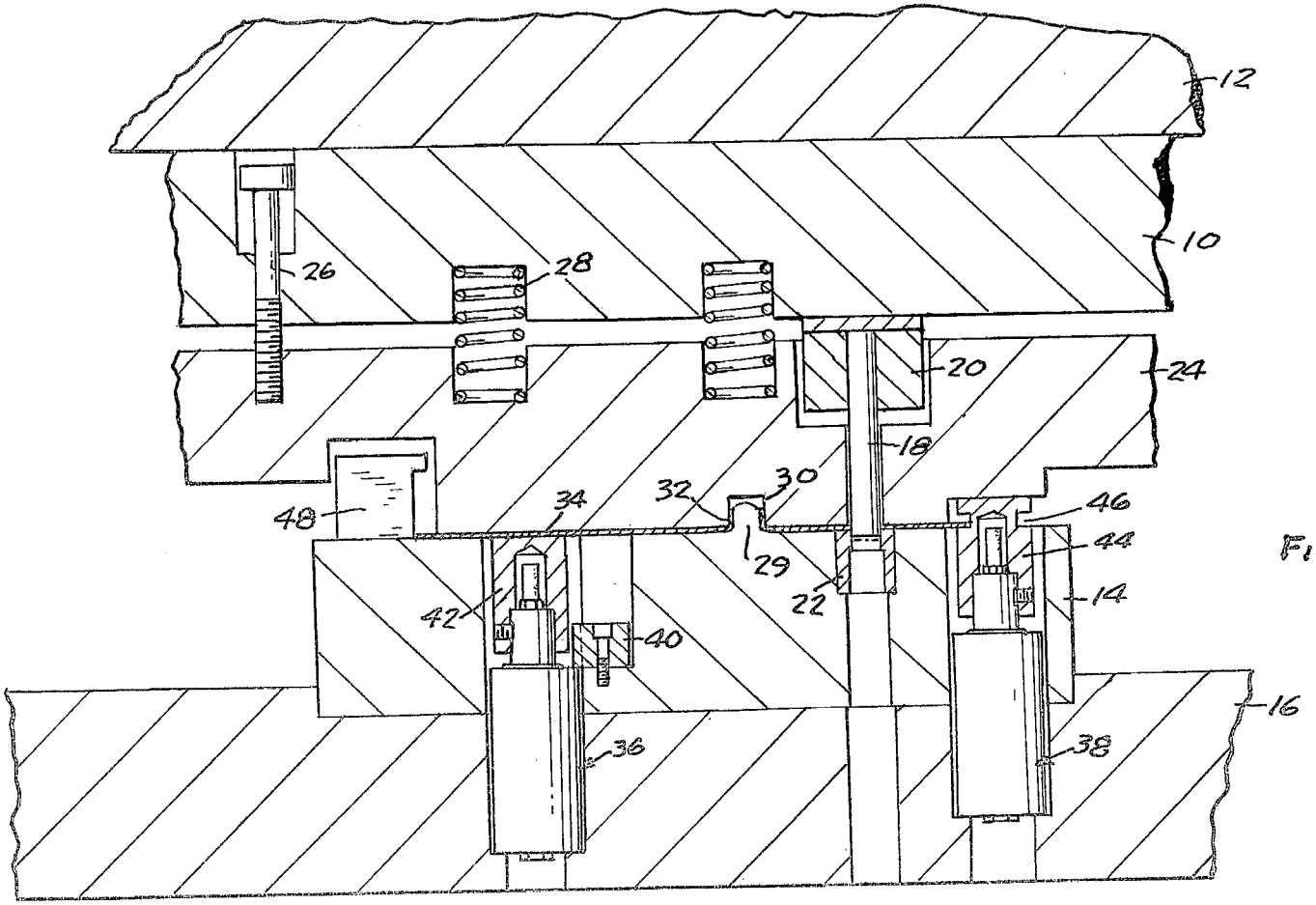
FIG. 1 is a transverse vertical sectional view through a progressive die embodying the stock lifter of the present invention.

In FIG. 1 there is illustrates a progressive die which includes an upper die member 10 secured to the vertically movable ram 12 of a press and a lower die member 14 secured to a base plate 16 in the press. A punch 18 is secured to the upper die member 10 by means of a punch retainer 20. An apertured die button 22 is mounted in the lower die member 14 in vertical alignment with punch 18. A hold down member 24 is connected to the upper die member 10 for vertical movement relative thereto by a plurality of screws 26 and is biased downwardly by compression springs 28 interposed between the upper die member 10 and the hold down member 24. The lower die member 14 includes an upward projection 29 which cooperates with a recess 30 on the hold down member 24 to form an annular flange 32 in the workpiece 34 when the ram descends to its lowermost position shown in FIG. 1. The arrangement thus far described is more or less conventional and operates in the manner of a conventional progressive die.

In FIG. 1 there is illustrated a pair of stock lifters 36,38 which are constructed in accordance with the present invention. Each of these stock lifters are located in aligned bores in the lower die member 14 and the base plate 16 and secured therein by means of clamps 40. The two stock lifters 36,38 are of identical construction except that the upper end of cap 42 on stock lifter 36 is flat and the upper end of cap 44 on stock lifter 38 is fashioned with an annular groove 46 which forms an edge guide along one side of the strip stock 34. The guide for the opposite longitudinal edge of the stock is designated 48 and is fixedly mounted on the lower die member 14.

The detailed construction of stock lifter 38 is illustrated in FIG. 3. The stock lifter consists of a cylinder in the form of a tube 50 which is internally threaded at its upper end as at 52 to receive a cap 54 and is also internally threaded at its lower end as at 56 to receive a cap 58. A sleeve bearing 60 has a slip fit within tube 50 for slideably guiding a piston 62 vertically within the cylinder. An annular bearing 64 on piston 62 has a close sliding fit with the inner periphery of sleeve bearing 60. A piston rod 66 having a diameter slightly smaller than piston 62 extends upwardly from the upper face of piston 62 and projects upwardly through an aperture 68 in the upper cylinder cap 54. Piston 62 and piston rod 66 are provided with a vertical through bore 70 which at its lower end communicates with the interior of the cylinder below piston 62 and which at its upper end is threaded as at 72 to receive a conventional gas filler valve stem 74. Bore 70 communicates with the portion of the cylinder above piston 62 by means of radial passageways 75. A conventional valve cap 76 is threaded over the upper end of valve stem 74. The piston rod cap 44 of stock lifter 38 is secured to the upper end of piston rod 66 by a screw 78 and is formed with a central socket 80 to accommodate valve stem 74 and valve stem cap 76.

Piston rod 66 is slideably guided in the cylinder primarily by a sleeve bearing 82 which is preferably press fitted within tube 50. The lower end of bearing 82 abuts the upper end of sleeve bearing 60 and the lower end of sleeve bearing 60 is seated upon a dished disc spring 84 which is seated on end cap 58 at the lower end of the cylinder. Piston rod 66 also has a close sliding fit with an annular spacer bearing 86 which in turn has a slip fit within the central bore 87 of top cap 54. An annular compressible seal 88 is interposed between bearing 82 and spacer bearing 86 and an annular rod wiper 90 is interposed between the upper end of bearing spacer 86 and the under side of top cap 54. Seal 88 is of a conventional type which is adapted to expand radially and, thus, effect a seal between piston rod 66 and the bore 87 of cap 54 in response to gas pressure directed against the lower face of the seal. When the cylinder is charged with gas as hereinafter explained seal 88 is biased upwardly against the lower end of spacer bearing 86 and bearing 86 is biased upwardly against rod wiper 90.

As is best illustrated in FIG. 4, rod wiper 90, which is formed of a resiliently compressible material such as rubber, has a body portion 92 of generally rectangular cross section and, at its upper end, a conically shaped flange or lip 94 which inclines upwardly and radially inwardly so that the annular face portion 96 is in wiping engagement with the outer periphery of piston rod 66. Rod wiper 90 is seated in a counterbore at the upper end of cap 54 which has a cylindrical side wall 98, a flat top wall portion 100, and an upwardly and radially inwardly inclined wall portion 102 which corresponds in shape and size with the outer periphery of flange 94. The inner periphery of body portion 92 below flange 94 has an inner diameter at least slightly larger than the outer diameter of piston rod 66 so as to provide a clearance space 104 therebetween. It will be observed that the central aperture 68 at the upper end of cap 54 has a diameter at least slightly larger than the outer diameter of piston rod 66.

In the specific embodiment illustrated the lower cylinder cap 58 on the tube 50 has a threaded central bore 106 which receives a safety blow out plug 108. At the upper end of plug 108 there is arranged a conventional rupture disc 110 which is adapted to fracture at a predetermined high pressure to allow the escape of gas from within the cylinder to the surrounding aperture through a passageway 112 in plug 108 in the event of an unduly excessive pressure in the cylinder.

In operation the cylinder is charged with a gas, preferably nitrogen, to a selected predetermined pressure which is only sufficient to lift the strip stock 34 from the top face of the lower die member 14 when the upper die member 10 is raised. The force required to lift the strip stock at the various stations of a progressive die may differ considerably depending upon the forming operations performed at each of the stations. For example, at the station shown in FIG. 1 a sufficient upward force must be applied to the stock to strip it from the extruding pin 29. At other stations the necessary lifting force on the strip stock may be substantially more or substantially less than at the station shown in FIG. 1. In any event, the lifters at each of the stations of the progressive die are charged to the desired pressure by removing the caps 42,44 from the upper ends of the piston rods 66 and connecting the valve stems 74 to a tank of pressurized nitrogen. Thereafter, the caps 42,44 are replaced and the stock lifters are in operative condition.

It will be appreciated that, since the center bore 70 communicates with portions of the cylinder above and below piston 62, the pressure within the cylinder will be exerted downwardly on rupture disc 110 and upwardly on seal 88. However, since the area of the bottom face of piston 62 which is exposed to the gas pressure within the cylinder is substantially greater than the area of the upper side of piston 62, the piston, together with its piston rod 66, will normally be displaced upwardly in the cylinder from the position shown in FIG. 3 to the solid line position shown in FIG. 2. In its fully raised position the upper face of piston 62 will abut against the lower end of bearing 82. Piston 62 assumes the position shown in FIG. 3 when the ram 12 of the press is at bottom dead center position.

With the above described arrangement it will be observed that, although the lifter is operated by fluid pressure, it it self-contained. More specifically, after the cylinder is initially charged it is disconnected from the pressure source and sealed. Furthermore, it will be observed that as the piston reciprocates vertically in the cylinder air from the surrounding atmosphere is not drawn into or exhausted from the cylinder. This is very desirable since the air and the environment surrounding such stamping dies is invariably contaiminated with dirt, oil, dust, etc. which, when deposited on the working surfaces of the cylinder, would produce considerable wear.

It will be appreciated, however, that the portion of piston rod 66 which extends above the upper cap 54 is exposed to the surrounding environment and, thus, over a considerable length of time, may be subjected to a certain degree of wear. However, the wiper 90 effectively prevents the ingress of dirt or other contaminants which may deposit around the outer periphery to the working surfaces of the piston and cylinder. As explained previously, the pressure within the cylinder is directed upwardly against the lower face of seal 88. This in turn produces an upward force on the seal which is transmitted to the bottom face of wiper 90 through the bearing spacer 86. This force places seal 88 in compression. The compressive force on the seal in combination with the upwardly inclined surface portion 102 on cap 54 urges flange 94 radially inwardly and, thus, maintains the annular face portion 96 of the seal in good wiping engagement with the outer periphery of the piston rod 66 even though the upper end portion of the piston rod may wear from continued use.

It will also be appreciated that the piston cylinder assembly herein shown and described is designed so that it can be manufactured economically as compared with conventional constructions. For example, the outer tube 50 requires little or no machining since it is a length of conventional tubing which is merely threaded at its opposite ends. The upper and lower end caps 54,58 can be machined inexpensively and are maintained in sealed relationship with tube 50 by the conventional O-rings 114. In addition, the utilization of the spring disc 84 in combination with the sleeve bearing 60 eliminates entirely the necessity for machining the various components of the cylinder to close axial dimensions. For example, while it is important that the caps 54,58 be firmly seated on the opposite ends of tubular member 50 so that the O-rings 114 will provide an effective seal therebetween, the axial dimension of these caps is not critical since variations in their dimensions can be compensated for by the flexing of disc spring 84.

I claim:

1. A stack lifter for a progressive die having upper and lower die members for forming workpieces therebetween, said stock lifter comprising a vertically disposed fluid cylinder fixedly mounted on the lower die member, a piston slideably arranged within said cylinder and having a piston rod extending upwardly through the upper end of the cylinder in sealed relation therewith, means sealing the lower end of the cylinder from the surrounding atmosphere, said piston rod having a smaller outer diameter than said piston so that the bottom face of the piston has a larger area than the top face thereof, said piston rod having an axial passageway extending downwardly from the upper end thereof and communicating freely with the portions of the cylinder above and below the piston, means adjacent the upper end of the piston rod communicating with said passageway for charging the cylinder to a selected predetermined gas pressure so that the piston is biased upwardly in the cylinder with a predetermined desired force and means at the upper end of the piston rod for engaging strip stock disposed between the die members and adapted to lift it from the lower die member when the upper die member is raised.

2. A stock lifter as called for in claim 1 wherein said charging means comprises a valve stem adapted to be releasably connected to a source of gas under pressure.

3. A stock lifter as called for in claim 2 wherein the valve stem projects upwardly from the upper end of the piston rod.

4. A stock lifter as called for in claim 3 wherein said stock engaging means comprises a cap member telescopically arranged over the upper end of the piston rod and enclosing said valve stem.

5. A stock lifter as called for in claim 1 wherein said passageway extends downwardly through the bottom face of the piston and including a radial passageway in said piston rod above the piston extending between said axial passageway and the portion of the cylinder above the piston whereby the gas flows freely between the portions of the cylinder above and below the piston through said radial passageway in response to vertical reciprocation of the piston in the cylinder.

6. A stock lifter as called for in claim 1 wherein said cylinder comprises a circular cylindrical tube having a generally uniform inner and outer diameter, the opposite ends of said tube being threaded, a threaded cap closing the lower end of said tube and a bushing threaded on the upper end of said tube, said bushing being centrally apertured to slideably accommodate the piston rod.

7. A stock lifter as called for in claim 1 including an annular bearing in said cylinder spaced from and below the upper end thereof and slideably engaging the piston rod, an axially displaceable annular seal disposed above said bearing and forming a sliding sealed connection between the cylinder and piston rod, said seal being adapted to be displaced upwardly and into sealing engagement with the cylinder and piston rod in response to the force applied to the bottom side thereof by the gas in the cylinder, the upper end of the cylinder having an annular recess therein spaced upwardly from said annular seal, said recess having an upper conical wall which is inclined radially inwardly in an upwardly direction, an annular piston rod wiper seated in said recess and having a body portion and a radially inwardly and axially upwardly inclined flange at the upper side thereof, said flange being biased upwardly against said conical wall so that it is urged radially inwardly to engage the outer periphery of the piston rod, said body portion being compressible and said flange being flexible and a rigid spacer extending between said annular seal and said wiper and adapted to exert an axial upward force on the body portion of the wiper in response to the application of gas pressure to the bottom side of said annular seal.

8. A stock lifter as called for in claim 7 wherein the inner periphery of said conical wall at the upper end thereof defines a circular opening through which the rod extends and which is slightly larger than the diameter of the piston rod.

9. A stock lifter as called for in claim 8 wherein said body portion below said inclined flange has an inner diameter less than the outer diameter of the piston rod.

10. A stock lifter as called for in claim 7 wherein the upper end of the cylinder comprises a centrally apertured bushing through which the piston rod extends, said bushing having a threaded connection with the cylinder, said recess being formed in said bushing.

11. A stock lifter as called for in claim 10 wherein the bushing is externally threaded and the cylinder is internally threaded, the lower end of the bushing bearing on the upper end of said bearing.

12. A stock lifter as called for in claim 1 wherein said cylinder comprises a tube having generally uniform inner and outer diameters, the lower end of said tube being closed by a plug threaded into the tube and sealed therewith by an O ring, the upper end of the tube being internally threaded, a centrally apertured bushing threaded into the upper end of the tube and sealed thereto by an O ring, the piston rod extending upwardly through said bushing, an annular bearing in said tube with which the piston rod is slideably engaged, the lower end of said bushing abutting downwardly on the upper end of the annular bearing, a compression spring in said cylinder seated on the upper face of said plug and an annular bearing spacer extending between and engaging the lower end of said bearing and the upper end of said spring whereby said spring and spacer retain the bearing up against the lower end of said bushing.

13. A stock lifter as called for in claim 12 wherein said spacer comprises a cylindrical sleeve having a close sliding fit with the inner periphery of said tube, said piston having an annular bearing thereon engaging the inner periphery of said cylindrical sleeve.

* * * * *